US008938976B2

(12) United States Patent
Moehrle et al.

(10) Patent No.: US 8,938,976 B2
(45) Date of Patent: Jan. 27, 2015

(54) STRUCTURAL FRAME FOR GAS TURBINE COMBUSTION CAP ASSEMBLY

(75) Inventors: Frank Moehrle, Palm City, FL (US); Luis Estrada, San German, PR (US); Jeremy Lefler, Stuart, FL (US); Martin Konen, Palm Beach Gardens, FL (US)

(73) Assignee: Siemens Energy, Inc., Orlando, FL (US)

( * ) Notice: Subject to any disclaimer, the term of this patent is extended or adjusted under 35 U.S.C. 154(b) by 690 days.

(21) Appl. No.: 13/238,403

(22) Filed: Sep. 21, 2011

(65) Prior Publication Data

US 2012/0291451 A1 Nov. 22, 2012

Related U.S. Application Data

(60) Provisional application No. 61/488,204, filed on May 20, 2011.

(51) Int. Cl.
*F02C 7/20* (2006.01)
*F23R 3/60* (2006.01)

(52) U.S. Cl.
CPC ..... *F23R 3/60* (2013.01)
USPC ..... 60/796

(58) Field of Classification Search
CPC ..... F23R 3/286; F23R 3/002; F23R 3/60; F02C 7/20
USPC ..... 60/39.12–39.19, 200.1, 227, 39.01, 60/39.21–39.3, 39.08–39.11, 228–269, 60/224–226.3, 39.3–39.465, 39.64, 60/39.821–39.83, 722–806, 39.47–39.59, 60/39.6–39.81, 202–220, 221–223, 737, 60/748, 740, 752, 756, 796–800; 137/15.1–15.2; 239/127.1, 127.3, 239/265.11–265.43
See application file for complete search history.

(56) References Cited

U.S. PATENT DOCUMENTS

| | | | | |
|---|---|---|---|---|
| 2,594,808 | A * | 4/1952 | Rubbra | 60/39.37 |
| 3,657,883 | A * | 4/1972 | De Corso | 60/39.37 |
| 5,274,991 | A | 1/1994 | Fitts | |
| 6,438,959 | B1 | 8/2002 | Dean et al. | |
| 6,923,002 | B2 | 8/2005 | Crawley et al. | |
| 7,637,111 | B2 * | 12/2009 | Pieussergues et al. | 60/798 |
| 2003/0217556 | A1 * | 11/2003 | Wiebe | 60/796 |
| 2008/0092547 | A1 * | 4/2008 | Lockyer et al. | 60/757 |
| 2008/0110174 | A1 * | 5/2008 | Brown et al. | 60/752 |
| 2009/0188255 | A1 * | 7/2009 | Green et al. | 60/737 |

(Continued)

FOREIGN PATENT DOCUMENTS

| | | | |
|---|---|---|---|
| GB | 000812404 | A * | 4/1959 |
| GB | 812404 | A1 | 4/1959 |

*Primary Examiner* — Phutthiwat Wongwian
*Assistant Examiner* — Thomas Burke

(57) ABSTRACT

An intermediate support frame (68) that spans an inner diameter of a support ring (48) of a gas turbine combustor cap assembly (24) at a position intermediate the length of the support ring. The intermediate support frame may have a central encirclement (72) that receives a central fuel pre-mix tube (44) of the combustor cap assembly, and may further have a circular array of outer stabilization rings (70) that each receive a respective outer pre-mix tube (42). The central pre-mix tube may be affixed to the central encirclement (72), for example by welding. The outer pre-mix tubes may be slidably engaged in the outer stabilization rings (70), providing lateral stability while allowing differential thermal expansion. The intermediate support frame may have holes (74) for coolant passage, and perimeter tabs (76) for attachment to the support ring (48).

16 Claims, 5 Drawing Sheets

(56) References Cited

U.S. PATENT DOCUMENTS

| | | | | |
|---|---|---|---|---|
| 2009/0293489 | A1 | 12/2009 | Tuthill et al. | |
| 2010/0050640 | A1* | 3/2010 | Belsom et al. | 60/734 |
| 2010/0058766 | A1* | 3/2010 | McMahan et al. | 60/747 |
| 2010/0089068 | A1* | 4/2010 | Ellis et al. | 60/796 |
| 2010/0242493 | A1* | 9/2010 | Cihlar et al. | 60/796 |
| 2010/0263384 | A1* | 10/2010 | Chila | 60/755 |
| 2010/0300106 | A1* | 12/2010 | Edwards et al. | 60/752 |
| 2011/0049112 | A1 | 3/2011 | Johnson et al. | |
| 2011/0067404 | A1* | 3/2011 | Johnson et al. | 60/747 |

* cited by examiner

STRUCTURAL FRAME FOR GAS TURBINE COMBUSTION CAP ASSEMBLY

This application claims benefit of the 20 May 2011 filing date of U.S. patent application No. 61/488,204, which is incorporated by reference herein.

FIELD OF THE INVENTION

This invention relates to structural aspects of a gas turbine combustor cap assembly.

BACKGROUND OF THE INVENTION

An industrial gas turbine engine combustion system may include several individual combustion device assemblies, for example as described in U.S. Pat. No. 5,274,991. These combustion device assemblies contain a fuel and oxidizer supply that may be composed of a single or multiple set of fuel and oxidizer injector mixing cavities. These cavities are referred to as pre-mix tubes. The primary purpose of the pre-mix tube is to supply a precisely metered and mixed fuel and oxidizer ratio for combustion. The pre-mix tubes are often supported in a cantilevered fashion from a primary feed structure, and pass through a relatively flexible screen known as an effusion plate. Pre-mix tubes have been known to liberate at the weld joint and cause significant downstream turbine damage.

SUMMARY OF THE INVENTION

Embodiments of the present combustion cap internal structural frame structurally stabilize all pre-mix tubes to one another and to the surrounding support ring. This arrangement provides improved stability within a cap assembly thereby preventing excessive relative displacements among the tubes and the support ring, thus reducing undesirable pre-mix tube dynamic displacements and resulting loads on the effusion plate. Embodiments of the present internal structural frame improve combustion system strength margins and combustion system dynamic capability.

BRIEF DESCRIPTION OF THE DRAWINGS

The invention is explained in the following description in view of the drawings that show.

DETAILED DESCRIPTION OF THE INVENTION

The present inventors have recognized that prior combustion cap assemblies are vulnerable to loads transferred between the pre-mix tubes and the effusion plate due to the dynamic response of the pre-mix tubes. Furthermore, combustion-induced vibration can occur in the individual pre-mix tubes, creating undesirable fatigue damage at the pre-mix tube welds and the potential for individual pre-mix tube liberation.

Figure 1:
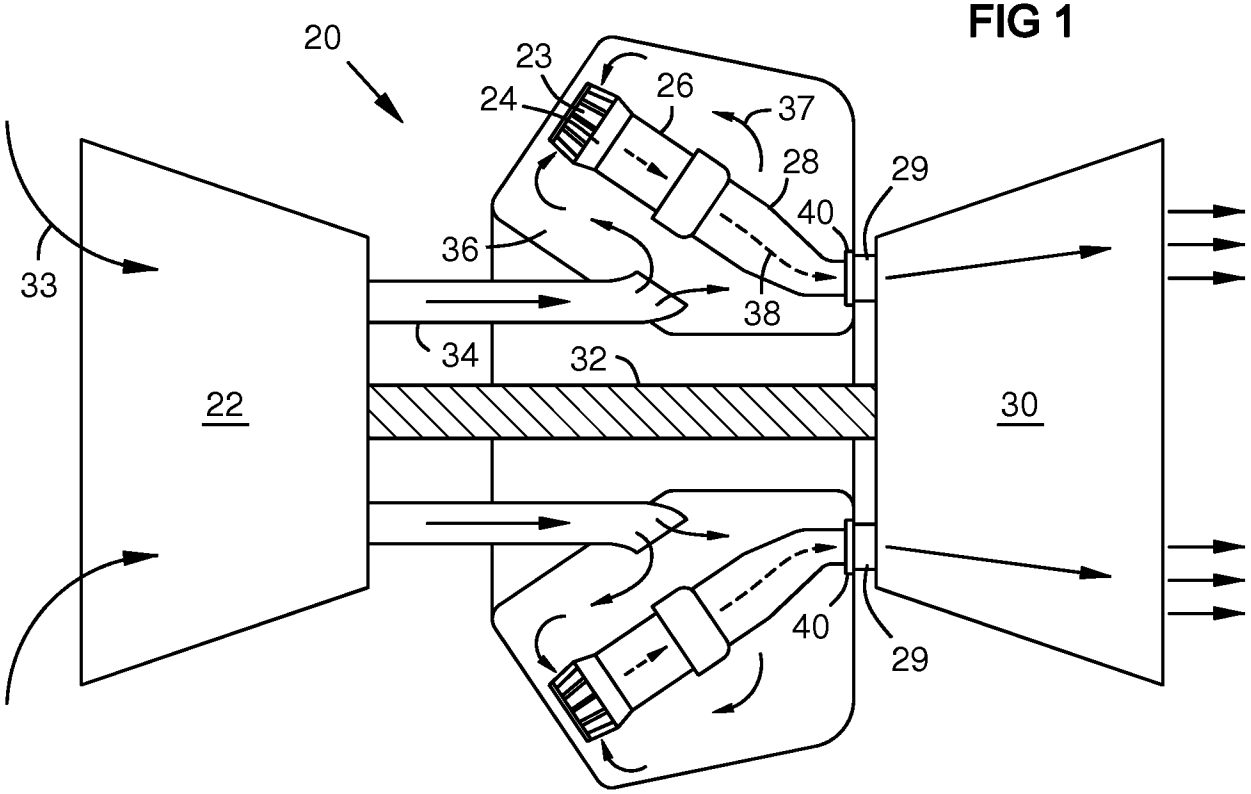
FIG. 1 is a schematic view of an exemplary gas turbine engine within which embodiments of the invention may reside.

FIG. 1 is a schematic view of an exemplary gas turbine engine 20 that includes a compressor 22, fuel injector assemblies also known as combustor cap assemblies 24, combustion chambers 26, transition ducts 28, a turbine section 30 and an engine shaft 32 by which the turbine 30 drives the compressor 22. Several combustor assemblies 24, 26, 28 may be arranged in a circular array in a can-annular design. In an exemplary embodiment, combustor assemblies 24, 26, 28 arranged in a can-annular design are reverse flow combustor assemblies as recognized by those skilled in the art but embodiments of the invention may be adapted for various types of combustor assemblies. During operation, the compressor 22 intakes air 33 and provides a flow of compressed air 37 to the combustor inlets 23 via a diffuser 34 and a combustor plenum 36. This compressed air 37 also serves as coolant for the combustion chambers 26 and transition ducts 28. The fuel injectors (not shown) within assembly 24 mix fuel with the compressed air. This mixture burns in the combustion chamber 26 producing hot combustion gas 38, also called the working gas, that passes through the transition duct 28 to the turbine 30 via a sealed connection between an exit frame 40 of the transition duct and a turbine inlet 29. The diffuser 34 and the plenum 36 may extend annularly about the engine shaft 32. The compressed airflow 37 in the combustor plenum 36 has higher pressure than the working gas 38 in the combustion chamber 26 and in the transition duct 28.

Figure 2:
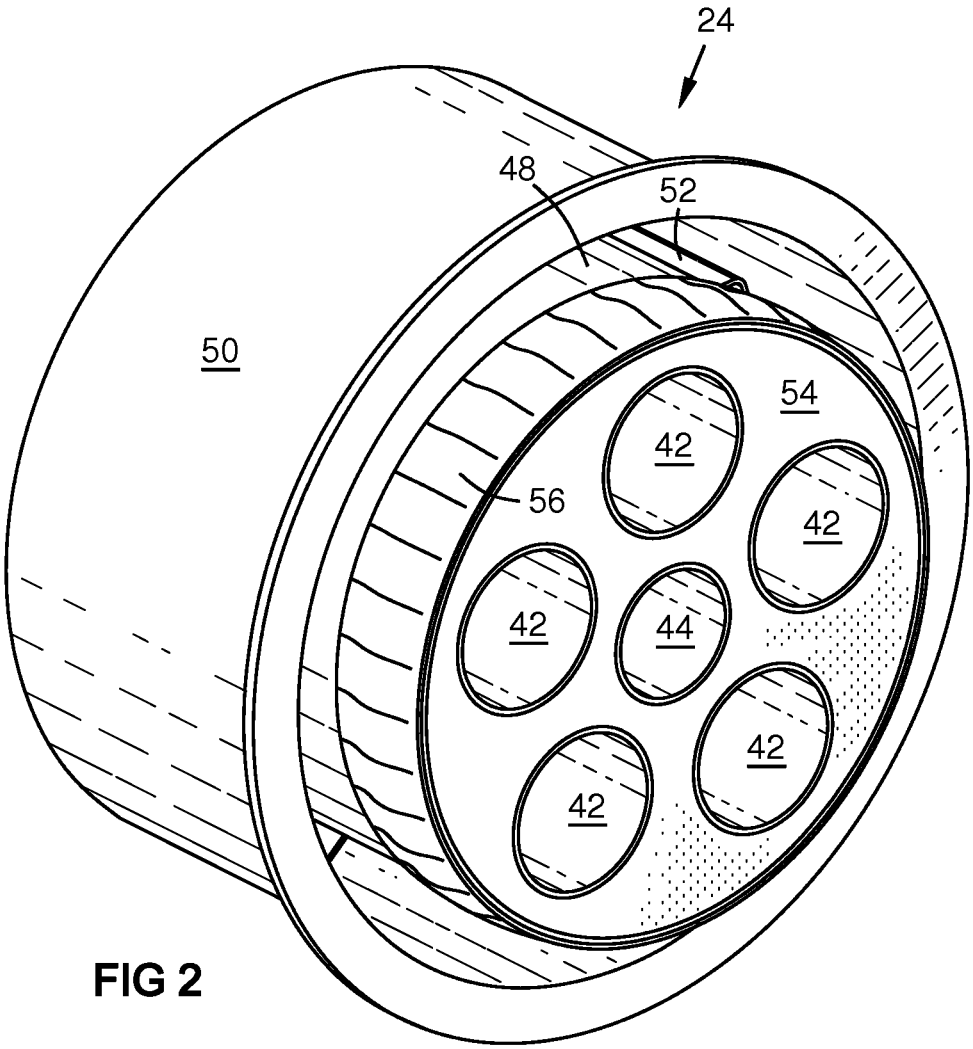
FIG. 2 is a perspective view of the downstream end of an exemplary combustor cap assembly within which embodiments of the invention may reside.

FIG. 2 is a perspective view of the downstream end of an exemplary fuel injector or combustor cap assembly 24 with a circular array of outer fuel/air pre-mix tubes 42 surrounding a central pre-mix tube 44. When fully assembled, fuel injectors (not shown) are mounted in these tubes. The cap assembly 24 may have a main support structure that may include inner and outer support rings 48, 50 interconnected by brackets 52. The downstream end of the tubes 42, 44 may be surrounded by an effusion plate 54, which may be perforated for effusion cooling by compressed air inside the inner ring 48 that bleeds through the perforations into the combustion chamber 26. An annular spring seal 56 may surround the downstream end of the inner support ring 48 for connecting the inner support ring 48 to the combustion chamber 26 liner.

Figure 3:
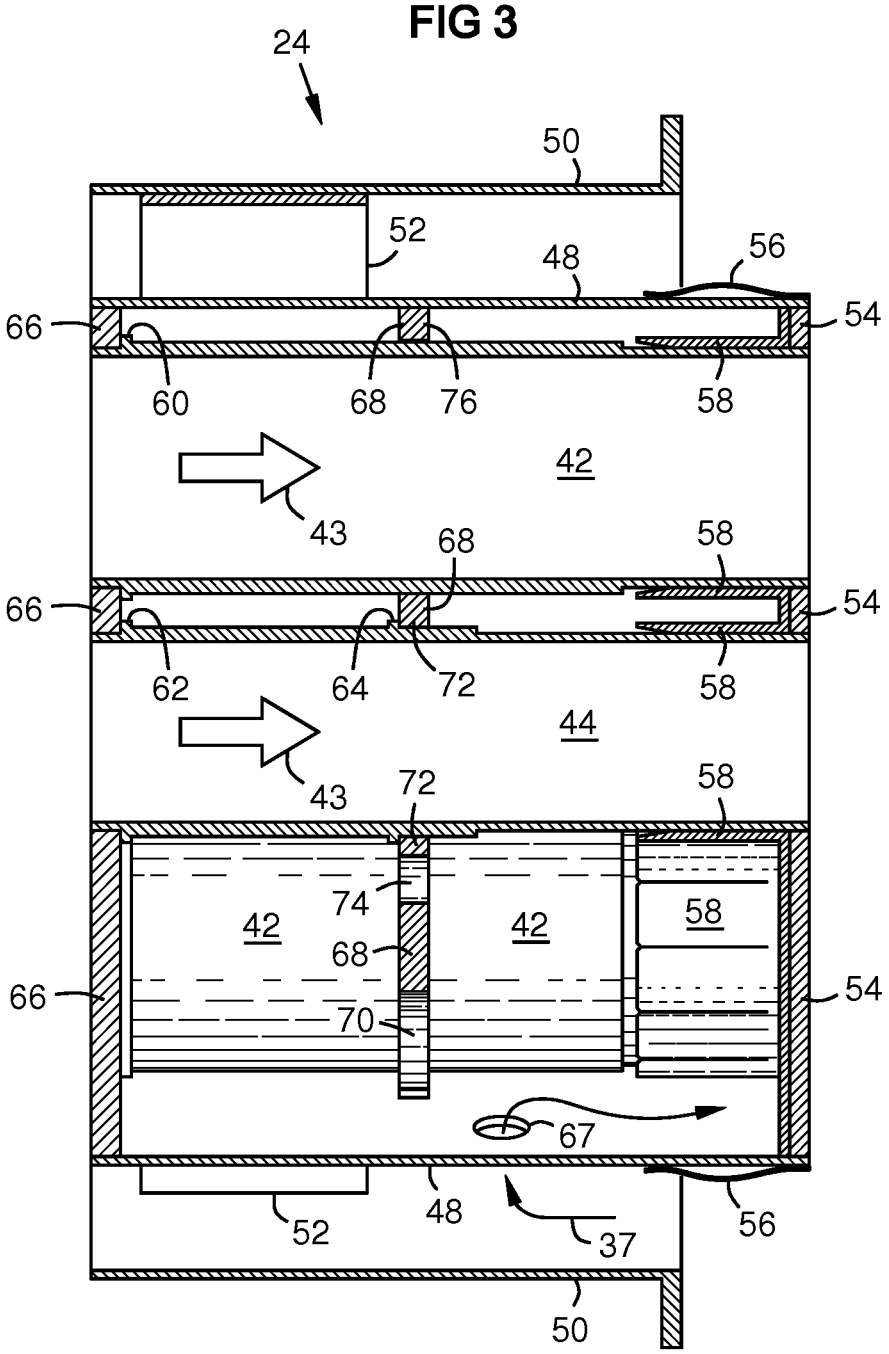
FIG. 3 is a sectional side view of the combustor cap assembly of FIG. 2 containing an exemplary embodiment of the invention.

FIG. 3 is a sectional side view of a combustor cap assembly 24 in accordance with one embodiment of the invention that may include a circular array or exemplary outer fuel/air pre-mix tubes 42 surrounding a central pre-mix tube 44 in accordance with aspects of the invention. The flow direction 43 of fuel and combustion air is indicated to orient the meaning of "upstream" or forward and "downstream" or aft herein. When fully assembled, fuel injectors (not shown) are mounted in these pre-mix tubes 42, 44. Each pre-mix tube 42, 44 may be used to individually isolate a fuel injection source allowing tuned mixing of fuel and oxidizer. The downstream end of each pre-mix tube 42, 44 may slide into a spring seal 58 attached to the effusion plate 54. The upstream end of each tube pre-mix 42, 44 may be attached to a primary feed plate 66, for example, by welding. The primary feed plate 66 may be attached across the upstream end of the inner support ring 48. Coolant inlet holes 67 may be provided in the inner support ring 48 for compressed air 37 that will exit through perforations in the effusion plate 54.

With further reference to FIG. 3, the upstream end of each pre-mix tube 42, 44 may have an upstream flange 60, 62 that retains and aligns the respective pre-mix tubes 42, 44 against the primary feed plate 66. The central pre-mix tube 44 and/or other pre-mix tubes 42 may have an intermediate flange 64 at a position intermediate the tube length that aligns and retains the respective pre-mix tube against an intermediate structural frame 68 or stiffening ring. The central pre-mix tube 44, or each pre-mix tube 42, 44 may be attached to the intermediate structural frame 68, for example, by welding around the flange 64.

In the illustrated embodiment of FIG. 3, the central pre-mix tube 44 is inserted through an encirclement 72 of the intermediate structural frame 68 with the intermediate flange 64 seating against the intermediate structural frame 68. The outer pre-mix tubes 42 are not necessarily fixed to the intermediate structural frame 68, but may instead be slidably engaged in respective encirclements or holes of stabilization rings 70 of the intermediate structural frame 68. This slidable engagement limits the relative lateral movement of the outer pre-mix tubes 42 while allowing differential thermal expansion.

Figure 4:
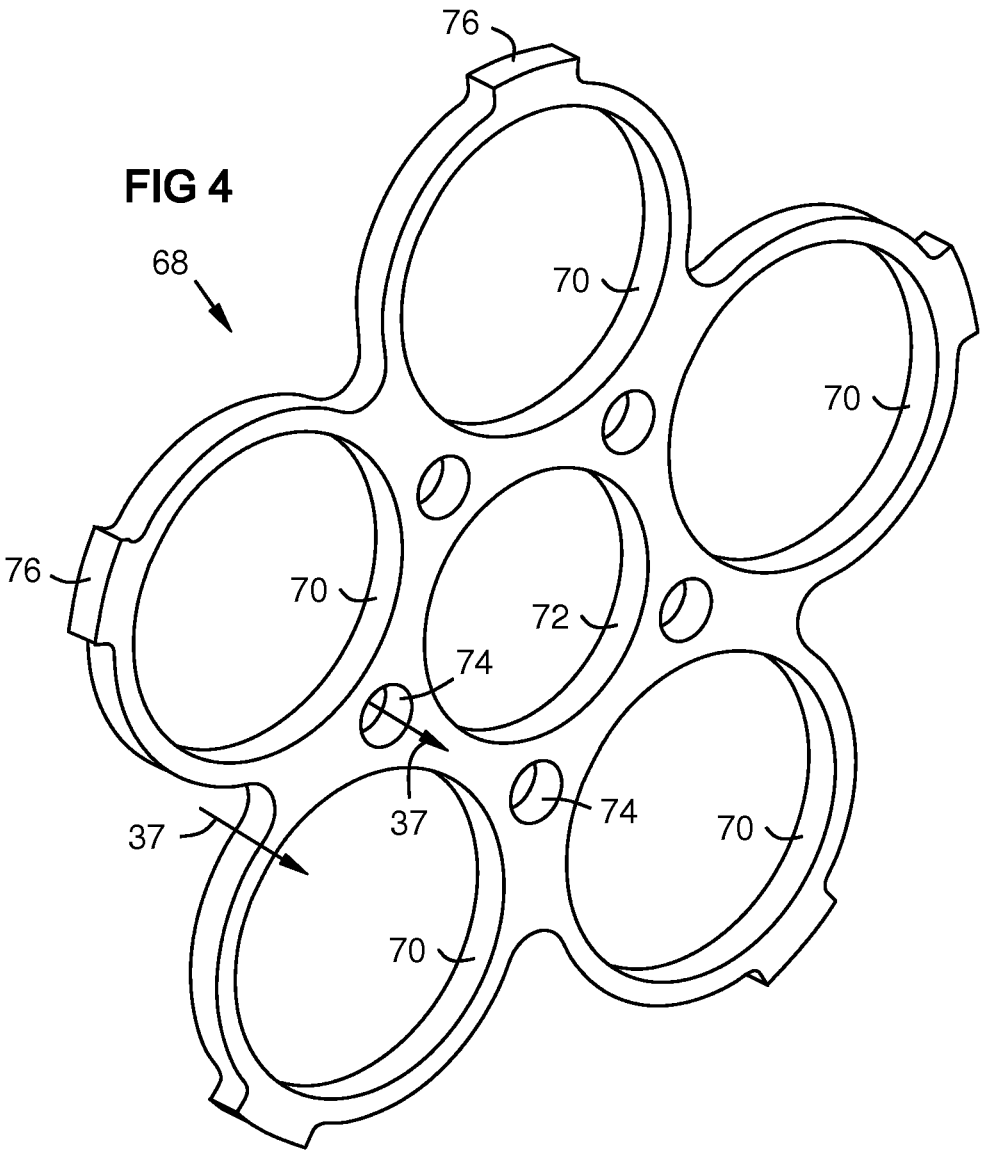
FIG. 4 is a perspective view of an exemplary intermediate structural frame in accordance with aspects of the invention.

FIG. 4 is a perspective view of an exemplary support frame for a combustor cap for a gas turbine engine in accordance with aspects of the invention. In the exemplary embodiment, a generally planar intermediate structural frame 68 may include a respective stabilization ring or encirclement 70 for each of the outer pre-mix tubes 42 and a central encirclement 72 for the central pre-mix tube 44. Holes 74 may be formed within portions of the intermediate structural frame 68 for weight reduction and coolant passage. The frame 68 is configured for attachment to the inner support ring 48 to provide the necessary mechanical interconnection between the tubes 42, 44 and the support ring 48. In the illustrated embodiment, perimeter tabs 76 are formed on perimeter surfaces of the intermediate structural frame 68 for attaching the frame 68 to the inner surface of the inner support ring 48.

The illustrated geometry is exemplary of any frame or plate with a respective hole forming a full encirclement for each of the pre-mix tubes 42, 44. Other embodiments may include one or more partial encirclements for one or more of the respective tubes, since full 360° support of each tube is not necessary so long as each tube is supported along the two axes of movement of a plane perpendicular to the direction of flow 43. The degree of support is preferably adequate to alter the dynamic response of the tubes and assembly in a beneficial manner to reduce peak stress and to extend fatigue life. In general, embodiments of a support frame may include a peripheral section which can be attached to the inner support ring 48 (tabs 76 in the illustrated embodiment) and an interior section attached to the peripheral section and making contact with each tube at a minimum of two points (encirclements 70, 72 in the illustrated embodiment). Some or all of the combustor cap coolant inlet holes 67 (FIG. 3) may be upstream of the intermediate structural frame 68. If so, coolant passage holes 74 and/or other pass-through voids as shown may be needed to provide passage of the coolant 37 to the effusion plate 54, particularly in embodiments such as FIG. 4 where full encirclements are used for each tube. One skilled in the art will appreciate that encirclements that provide less than 360° contact with the tubes may provide increased area for the flow of the coolant 37, while still providing adequate mechanical support.

Figure 5:
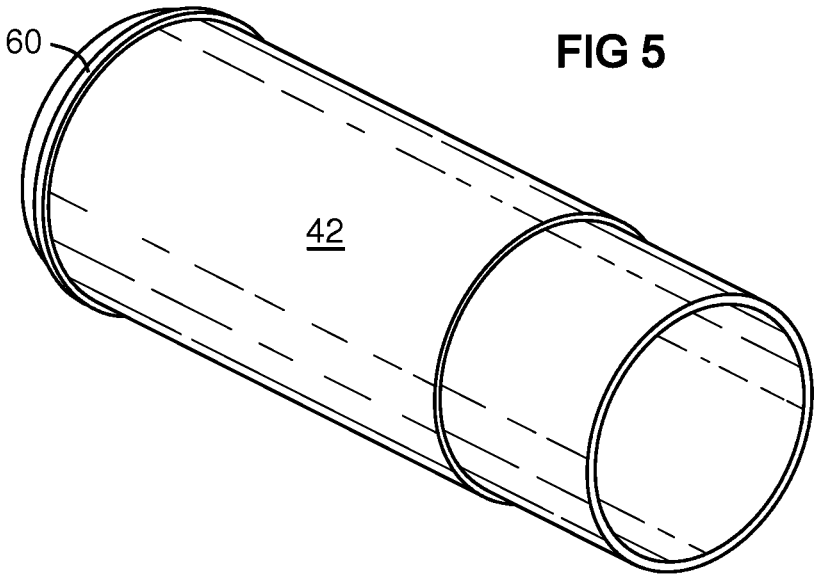
FIG. 5 is a perspective view of an exemplary outer pre-mix tube with an upstream flange in accordance with aspects of the invention.
Figure 6:
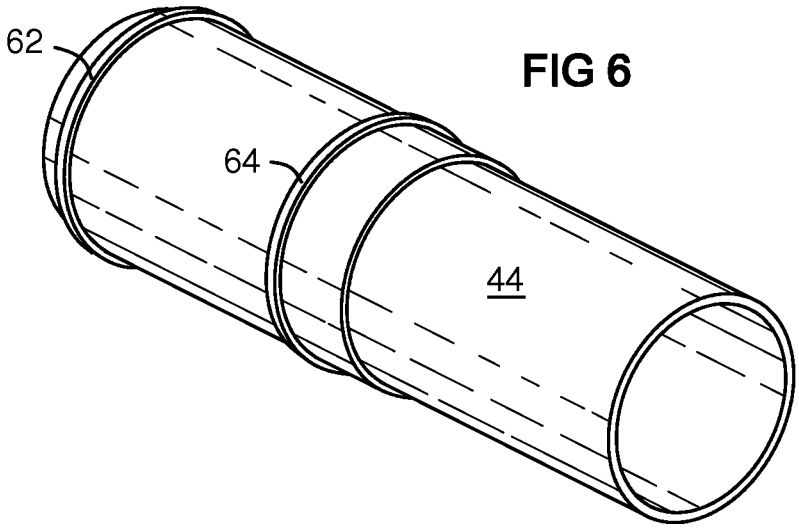
FIG. 6 is a perspective view of an exemplary central pre-mix tube with an upstream flange and an intermediate flange in accordance with aspects of the invention.

FIG. 5 is a perspective view of an exemplary pre-mix tube 42 with an upstream flange 60. FIG. 6 is a perspective view of an exemplary pre-mix tube 44 with an upstream flange 62 and an intermediate flange 64.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A structural support for a combustion cap assembly of a gas turbine engine, comprising:

a generally planar frame spanning an inner diameter of an inner support ring of the combustion cap assembly at an intermediate position between an upstream end and a downstream end of the inner support ring relative to a direction of flow of a fuel and air through the combustion cap assembly;

a central encirclement formed in the frame and configured for receiving a central pre-mix tube of a combustion cap assembly; and an array of outer stabilization rings formed in the frame, each stabilization ring configured to receive a respective outer pre-mix tube of the combustion cap assembly;

wherein the each stabilization ring slidably supports the respective outer pre-mix tube for differential thermal expansion of the respective pre-mix tube relative to the inner support ring in the direction of flow.

2. The structural support of claim 1, wherein the central encirclement and the stabilization rings provide 360° support for each respective tube.

3. The structural support of claim 1, wherein each of the central encirclement and stabilization rings comprises a respective hole formed in the frame for receiving a respective one of the pre-mix tubes.

4. The structural support of claim 1, further comprising a coolant passage formed in the frame between the central encirclement and the outer stabilization rings.

5. The structural support of claim 1, further comprising a tab formed on a perimeter of each of the stabilization rings.

6. A structural support for a combustion cap assembly of a gas turbine engine, comprising:

a peripheral section configured for attachment to an inner support ring of a combustion cap assembly; and an interior section attached to the peripheral section and comprising a plurality of encirclements for making contact with each of a plurality of pre-mix tubes of the combustion cap assembly;

wherein the interior section spans an inner diameter of the inner support ring at an intermediate position between an upstream end and a downstream end of the inner support ring relative to a direction of flow of a fuel and air through the combustion cap assembly; and the encirclements slidably support at least some of the pre-mix tubes, allowing a slidable thermal expansion of said at least some of the pre-mix tubes relative to the inner support ring in the direction of flow.

7. The structural support of claim 6, wherein the interior section further comprises a centrally located hole providing full 360° support for a centrally disposed one of the pre-mix tubes.

8. The structural support of claim 7, wherein the interior section further comprises an array of holes disposed about the centrally located hole and providing full 360° support for each of a plurality of outer pre-mix tubes.

9. The structural support of claim 6, wherein the interior section further comprises;

a centrally located encirclement for providing support for a centrally located one of the pre-mix tubes; and a plurality of stabilization rings disposed about the centrally located encirclement for providing support for outer ones of the pre-mix tubes.

10. The structural support of claim 9, wherein the peripheral section comprises a tab formed on a perimeter of each of the stabilization rings.

11. The structural support of claim 10, further comprising a hole formed in the interior section for the passage of coolant.

12. The structural support of claim 9, wherein the centrally located encirclement and the plurality of stabilization rings provide full 360° support for each respective pre-mix tube.

13. The structural support of claim 12, further comprising a hole formed in the interior section for the passage of coolant.

14. A gas turbine combustion cap assembly, comprising:

a support ring comprising a length between an upstream end and a downstream end of the support ring with respect to a direction of flow of a fuel and air through the combustion cap assembly;

a primary feed plate across the upstream end of the support ring;

a plurality of pre-mix tubes comprising respective upstream ends fixed to the primary feed plate around respective holes in the primary feed plate;

an effusion plate across the downstream end of the support ring;

the plurality of pre-mix tubes comprising respective downstream ends attached to the effusion feed plate around respective holes in the effusion plate; and an intermediate structural frame fixed to the support ring and spanning an inner diameter thereof at a position intermediate the length of the support ring;

wherein the intermediate structural frame supports each of the pre-mix tubes against movement thereof in a plane perpendicular to the direction of flow, and supports at least some of the pre-mix tubes for slidable movement of said at least some of the pre-mix tubes relative to the support ring in the direction of flow.

15. The gas turbine combustion cap assembly of claim 14, wherein the plurality of pre-mix tubes comprises a central pre-mix tube fixed to the intermediate structural frame; and a circular array of outer pre-mix tubes surrounding the central pre-mix tube, the outer pre-mix tubes are slidably supported by the intermediate structural frame.

16. The gas turbine combustion cap assembly of claim 15, further comprising:

the respective upstream ends of the pre-mix tubes being fixed around the respective holes in the primary feed plate; and the respective downstream ends of the pre-mix tubes being inserted into respective spring seals attached to the effusion plate around the respective holes therein.

* * * * *